US009062888B2

(12) United States Patent
Tadokoro et al.

(10) Patent No.: US 9,062,888 B2
(45) Date of Patent: Jun. 23, 2015

(54) AIR CONDITIONER

(75) Inventors: Takahide Tadokoro, Chiyoda-ku (JP); Yasuaki Kato, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1054 days.

(21) Appl. No.: 12/747,596

(22) PCT Filed: Feb. 3, 2009

(86) PCT No.: PCT/JP2009/051736

§ 371 (c)(1),
(2), (4) Date: Jun. 11, 2010

(87) PCT Pub. No.: WO2009/113338

PCT Pub. Date: Sep. 17, 2009

(65) Prior Publication Data

US 2010/0269537 A1 Oct. 28, 2010

(30) Foreign Application Priority Data

Mar. 11, 2008 (JP) ..... 2008-060803

(51) Int. Cl.
*F25D 17/04* (2006.01)
*F24F 1/38* (2011.01)
(Continued)

(52) U.S. Cl.
CPC ..... *F24F 1/38* (2013.01); *F04D 29/526* (2013.01); *F04D 29/545* (2013.01); *F24F 2013/205* (2013.01); *F24F 1/16* (2013.01); *F24F 1/46* (2013.01)

(58) Field of Classification Search
CPC ..... F04D 25/12; F04D 29/164; F04D 29/44; F04D 29/526; F04D 29/545; F04D 29/667; F24F 1/0011; F24F 1/38; F24F 2013/205
USPC ..... 62/404, 411, 419, 426, 428; 454/201, 454/203, 292, 306, 346
See application file for complete search history.

(56) References Cited

U.S. PATENT DOCUMENTS 3,035,422 A * 5/1962 Halbeisen ..... 62/426
5,967,748 A * 10/1999 Jang ..... 415/211.1
2005/0039479 A1* 2/2005 Kim ..... 62/262

FOREIGN PATENT DOCUMENTS

JP 3-168395 A 7/1991
JP 5-071768 A 3/1993
(Continued)

OTHER PUBLICATIONS

Machine Translation of JP 10-068537.*
(Continued)

*Primary Examiner* — Mohammad M Ali
*Assistant Examiner* — Christopher R Zerphey
(74) *Attorney, Agent, or Firm* — Buchanan Ingersoll & Rooney PC

(57) ABSTRACT

An air conditioner includes a propeller fan within a unit body, an L-shaped heat exchanger on a lateral surface and a rear surface of the unit body, a bell mouth installed radially outward of the propeller fan, and a plate to partition compressor space from propeller fan space, and to guide an airstream from the heat exchanger toward the bell mouth. A first bell mouth portion, which includes a sectional position and thereabout where a length of a segment connecting an end of the heat exchanger on a fan rotating direction side and a fan center is maximized, extends toward an upstream side longer than a second bell mouth portion which is located at a sectional position in a line-symmetrical relation to the first bell mouth portion with respect to a vertical line passing the fan center.

5 Claims, 19 Drawing Sheets

(51) Int. Cl.

| | |
|---|---|
| ***F04D 29/52*** | (2006.01) |
| ***F04D 29/54*** | (2006.01) |
| ***F24F 1/16*** | (2011.01) |
| ***F24F 1/46*** | (2011.01) |
| *F24F 13/20* | (2006.01) |

(56) References Cited

FOREIGN PATENT DOCUMENTS

| | | | |
|---|---|---|---|
| JP | 10-068537 | A | 3/1998 |
| JP | 2769211 | | 6/1998 |
| JP | 10-238815 | A | 9/1998 |
| JP | 11-173605 | A | 7/1999 |
| JP | 2002-221341 | A | 8/2002 |
| JP | 3582366 | | 10/2004 |
| JP | 2006-077585 | A | 3/2006 |
| JP | A-2007-205664 | | 8/2007 |
| JP | A-2007-292443 | | 11/2007 |

OTHER PUBLICATIONS

Office Action (Notification of Reasons for Refusal) dated Apr. 17, 2012, issued in corresponding Japanese Patent Application No. 2010-502740, and an English Translation thereof. (3 pages).

Office Action dated Aug. 16, 2012, issued in corresponding Chinese Patent Application No. 200980102796.9, and an English Translation thereof. (4 pages).

International Search Report (PCT/ISA/210) for PCT/JP2009/051736 dated May 19, 2009.

Dec. 12, 2013 extended European Search Report issued in EP 09 71 8597.

* cited by examiner

ENLARGED VIEW OF REGION INCLUDING PARTS OF FIRST BELL MOUTH PORTION AND BLADE (a)

AIR CONDITIONER

TECHNICAL FIELD

The present invention relates to an air conditioner for use in an air conditioning apparatus, a freezer, etc., and more particularly to an outdoor unit of the air conditioner.

BACKGROUND ART

An outdoor unit of a known air conditioner includes, for example, a unit body formed in a rectangular parallelepiped shape, a propeller fan and a fan motor for rotationally driving the propeller fan, which are installed in the unit body, a heat exchanger installed in an L-shape and extending along a side surface and a rear surface of the unit body, a bell mouth installed radially outward of the propeller fan, and a partition plate (also called a separator) disposed to partition an installation space of a compressor for supplying a refrigerator to the heat exchanger and an installation space of the propeller fan and to guide an airstream from the heat exchanger toward the bell mouth.

In the known air conditioner constructed as described above, when the propeller fan is rotated, an airstream is caused to pass through the heat exchanger from the outside of the unit body to be subjected to heat exchange and to be discharged to the outside of the unit body after passing through the bell mouth.

Recently, more power saving and quieter operation have been demanded in air conditioners and, to meet those demands, proposals have been made on configurations adapted for reducing noise of a propeller fan, which is a source of aerodynamic noise. In one example of the proposals, a bell mouth on a separator side is extended toward an upstream side to smoothen an airstream, thus increasing efficiency of the propeller fan and reducing the noise (see Patent Document 1). In another example of the proposals, to control the airstream flowing into a circular propeller fan even in a unit having a rectangular parallelepiped shape, the radius of curvature of the bell mouth on a sucking side is changed depending on the size of a surrounding space (see Patent Document 2). In still another example of the proposals, a soundproofing partition plate is formed in a duct-like or hood-like shape, thus causing the airstream from the heat exchanger to smoothly flow into the propeller fan (see Patent Document 3).

[Patent Document 1] Japanese Unexamined Patent Application Publication No. 2006-77585 (pages 4-5 and FIG. 1)

[Patent Document 2] Japanese Unexamined Patent Application Publication No. 3-168395 (page 2 and FIGS. 2 and 3)

[Patent Document 3] Japanese Unexamined Patent Application Publication No. 10-238815 (page 3 and FIGS. 1 and 2)

DISCLOSURE OF THE INVENTION

Problems to be Solved by the Invention

Because the propeller fan mounted in the unit body is surrounded by the heat exchanger, the partition plate (separator), and walls of the unit body, an air path is asymmetrical as viewed in the axial direction of the propeller fan. Considering airstreams in the known construction of the unit body, the airstream incoming from the lateral side of the unit body (i.e., the side where the heat exchanger is installed) primarily flows in the radial direction of the propeller fan. Meanwhile, on the separator side, a gap between the propeller fan and the wall is small and the airstream primarily flows in the axial direction of the propeller fan. Therefore, the direction of the airstream flowing to a blade changes while the blade rotates one revolution. In other words, a flow field around the blade varies. In Patent Document 1, the bell mouth on the separator side is extended toward the upstream side such that the airstream is caused to smoothly flow into the heat exchanger. Even with such an arrangement, however, the direction of the airstream incoming from the lateral side of the unit body in which the heat exchanger is installed and the direction of the airstream incoming from the rear side of the unit body still remain different from each other. Accordingly, variations of the flow field remain the same. Further, although the arrangement proposed in Patent Document 2 enables the airstream incoming from the lateral side of the unit body (i.e., the side where the heat exchanger is installed) to smoothly flow into the propeller fan, the flowing-in direction of the airstream cannot be changed and hence a phenomenon that the flowing-in direction of the airstream to the blade is changed in the circumferential direction remains the same as before. The variations of the flow field causes variations of a load applied to the blade, thus increasing the noise. Moreover, because a rotational speed of the propeller fan is constant and an axial component of speed of the airstream flowing to the blade varies, an angle at which the airstream flows in to strike against a front edge of the blade (i.e., an incident angle) also changes. At a place where the incident angle is increased, there occurs a stall, which increases the noise and reduces efficiency of the blade, thus deteriorating the performance. A stall is apt to occur on the lateral side of the unit body (i.e., the side where the heat exchanger is installed) in which the airstream flows into the propeller fan in the radial direction, and air blown off from the propeller fan tends to become a stream spreading in the radial direction. This causes a phenomenon that the airstream is sucked again into the heat exchanger installed on the lateral side of the unit body (i.e., a short cycle phenomenon). As a result, the efficiency of heat exchange decreases and the performance deteriorates.

In view of the above-described problems, an object of the present invention is to provide an air conditioner which can realize an improvement in efficiency of a propeller fan and a reduction of noise by partially extending a bell mouth toward the upstream side in consideration of asymmetry of an air path with respect to the propeller fan.

Means for Solving the Problems

An air conditioner according to the present invention comprises a propeller fan installed within a unit body, an L-shaped heat exchanger installed to extend along a lateral surface and a rear surface of the unit body, a bell mouth installed radially outward of the propeller fan, and a partition plate disposed to partition an installation space of a compressor for supplying a refrigerator to the heat exchanger and an installation space of the propeller fan from each other and to guide an airstream from the heat exchanger toward the bell mouth, wherein the bell mouth is formed such that, on a lateral side of the unit body where the heat exchanger is arranged, a first bell mouth, portion, which includes a sectional position and thereabout where a length of a segment connecting an end of the heat exchanger on a forward side in a fan rotating direction and a fan center is maximized, is extended toward an upstream side longer than a second bell mouth portion which is located at a sectional position in a line-symmetrical relation to the first bell mouth portion with respect to a vertical line passing the fan center.

Advantages of the Invention

According to the thus-constructed air conditioner of the present invention, an airstream incoming from the lateral side of the unit body where the heat exchanger is arranged is blocked by the first bell mouth portion which is extended longer toward the upstream side. Therefore, such an airstream is hard to flow into the propeller fan from a side thereof and is changed from a radial stream to a stream axially flowing into the propeller fan. In a region nearer to the partition plate (separator) and thereabout on the opposite side to the lateral side of the unit body with respect to a central axis of the propeller fan, an airstream flows primarily in the axial direction. Thus, flowing-in directions of the airstreams into the propeller fan are made constant all over the circumferential direction. In other words, a flow field flowing into a blade is uniformalized. As a result, flow variations caused while the blade rotates one revolution is reduced and a reduction of noise is realized. Further, since the speed of the airstream axially flowing into the propeller fan is increased, the incident angle of the airstream to the blade is improved and a stall is less apt to occur. Prevention of a stall contributes to reducing noise and avoiding deterioration of efficiency of the propeller fan. In addition, since the airstream blown off from the propeller fan becomes harder to spread in the radial direction, a phenomenon that the blown-off airstream is sucked again from the lateral side of the unit body (i.e., a short cycle phenomenon) is less apt to occur, and deterioration of performance can be prevented.

REFERENCE NUMERALS

1 unit body, 1*a* lateral wall of unit body, 2 boss, 3 blade, 4 propeller fan, 5 fan motor, 6 bell mouth, 6*a*, 6*a*' first bell mouth portion, 6*b* second bell mouth portion, 6*c* third bell mouth portion, 6*d* fourth bell mouth portion, 7 fan guard, 8 heat exchanger, 8*a* lateral-side heat exchanger, 8*b* rear-side heat exchanger, 9 compressor, 10 separator (partition plate), 11 airstream, 12 rotating direction of propeller fan, 13 end of lateral-side heat exchanger, 14 fan center, 15 straight line connecting end of lateral-side heat exchanger and fan center, 16 vertical line passing fan center, 17 upstream extension length of bell mouth, 18 stream flowing in radial direction of propeller fan, 19 stream flowing in axial direction of propeller fan, 20 relative flow direction of airstream flowing to blade, 21 circumferential speed of blade, 22 speed of axial airstream flowing to blade, 23 incident angle, 24 line tangential to curved line at front edge of blade, 25 vortex, 26 short cycle phenomenon, 27 vicinity of position where outer peripheral portion of propeller fan and heat exchanger are positioned close to each other, 28 cylindrical portion, 29 vortex at blade end, 30 point at which radial end of upstream-side sucking portion of bell mouth intersects vertical line 16, 31 horizontal line passing point 30, 32 length by which first bell mouth portion extends radially outwards from horizontal line 31, 33 corner of lateral wall of unit body, 34 straight line connecting corner of lateral wall and fan center, 35 place where length of bell mouth changes, 36 upstream inlet section of first bell mouth portion, 37 electrical component, 38 intermediate partition plate, and 39 unit wall surface.

BEST MODE FOR CARRYING OUT THE INVENTION

Embodiment 1

Figure 1:
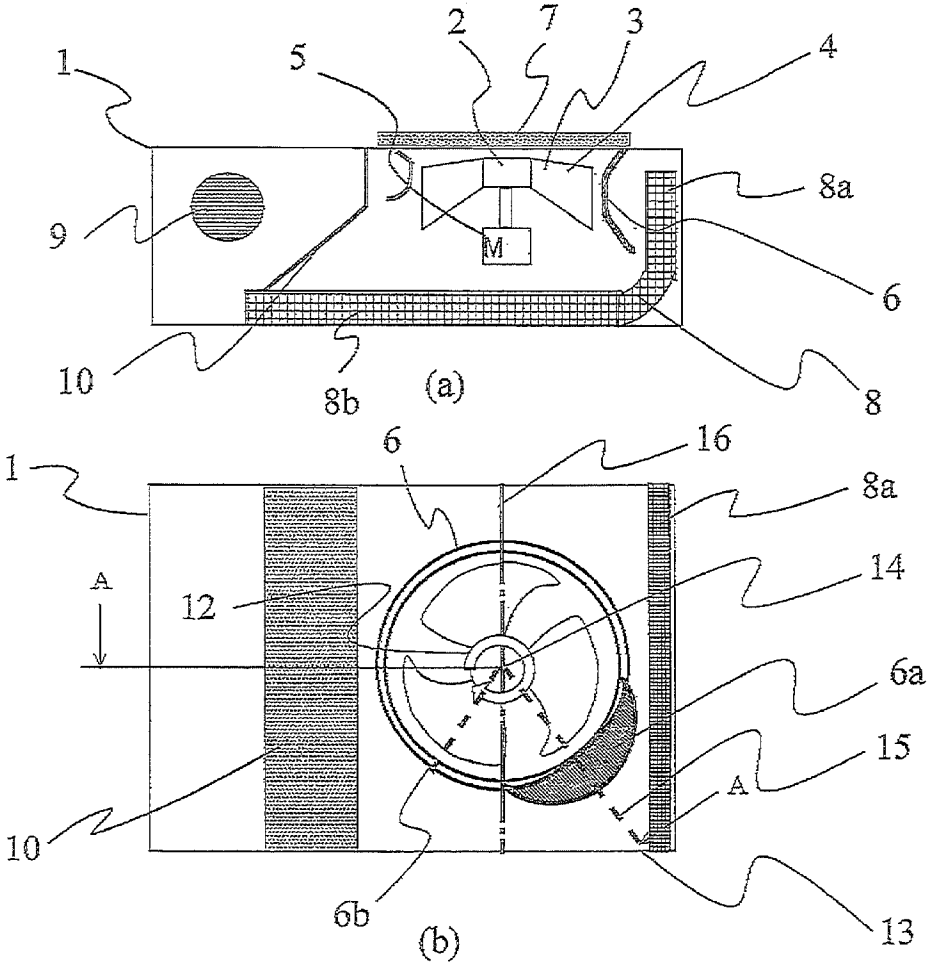
FIG. 1 illustrates the construction of an air conditioner according to Embodiment 1 of the present invention.

FIG. 1 illustrates the construction of an air conditioner according to Embodiment 1 of the present invention. More specifically, FIG. 1(*a*) is a sectional view of the air conditioner when viewed from above, and FIG. 1(*b*) is a rear view when viewed from the sucking side (with a heat exchanger being partly omitted).

The air conditioner includes a unit body 1 formed in a parallelepiped shape. A propeller fan 4 is installed within the unit body 1, the propeller fan 4 having a plurality of blades 3 mounted to and around a boss 2 which serves as a center of rotation. The propeller fan 4 is rotationally driven by a fan motor 5 installed on the rear side of the propeller fan 4. The fan motor 5 is mounted to a holding member (not shown) to be held in place. A bell mouth 6 having a sucking-side opening and a blowoff-side opening is installed radially outward of the propeller fan 4. The bell mouth 6 is mounted to a front panel of the unit body 1. Further, a fan guard 7 is externally mounted to the unit body 1 so as to cover a blowoff port which is formed in the front panel.

A heat exchanger 8 is made up of fins and pipes and is arranged in an L-shape extending along a lateral surface and a rear surface of the unit body 1 so as to surround the propeller fan 4. Hereinafter, a heat exchanger portion arranged on the lateral side of the unit body 1 is referred to as a "lateral-side heat exchanger 8*a*" and a heat exchanger portion arranged on the rear side of the unit body 1 is referred to as a "rear-side heat exchanger 8*b*". In each of the lateral and rear surfaces of the unit body 1, a plurality of sucking ports are formed in an opposed relation to the lateral-side heat exchanger 8*a* and the rear-side heat exchanger 8*b*, respectively.

A space in which a compressor 9 for supplying a refrigerator to the heat exchanger 8 and a space in which the propeller fan 4 is installed are partitioned by a partition plate that is also called a separator 10.

The bell mouth 6 in this embodiment is shaped such that, on the lateral side of the unit body where the lateral-side heat exchanger 8*a* is arranged, a first bell mouth portion 6*a*, which includes a sectional position and thereabout where a length of a segment 15 connecting an end 13 of the lateral-side heat exchanger 8*a* on a fan rotating direction 12 side (e.g., a lower end of the rear side of the unit body in the drawing, though depending on the fan rotating direction) and a fan center 14 is maximized, is extended toward the upstream side longer than a second bell mouth portion 6*b*, which is located at a sectional position in a line-symmetrical relation to the first bell mouth portion 6*a* with respect to a vertical line 16 passing the fan center 14. It is to be noted that, for easier understanding of the shape of the first bell mouth portion 6*a* extending toward the upstream side, its section which is in fact obliquely positioned is drawn in a cross-section diagram of FIG. 1(*b*) on a horizontal plane. Such a drawing scheme is similarly applied to subsequent figures. FIG. 1(*a*) illustrates a section taken along a plane including the segment 15 (i.e., a section taken along A-A in FIG. 1(*b*)).

Figure 2:
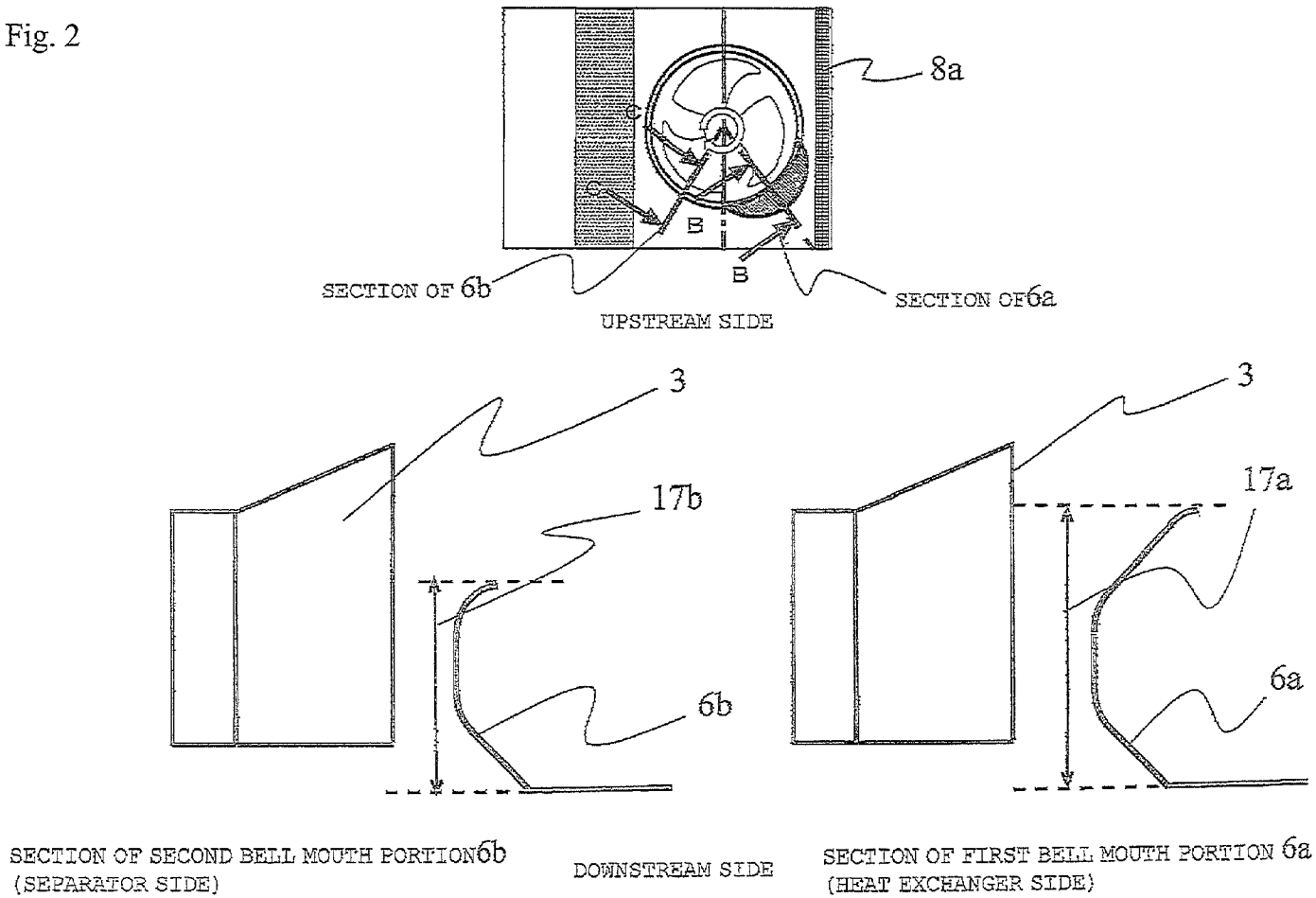
FIG. 2 illustrates the positional relationships between first and second bell mouth portions and a blade of a propeller fan in Embodiment 1.

FIG. 2 illustrates sections, taken along two lines, of the first and second bell mouth portions (i.e., the positional relationships between the blade 3 of the propeller fan and the first and second bell mouth portions 6*a* and 6*b*). In the unit body 1 including the lateral-side heat exchanger 8*a* arranged therein, comparing the first bell mouth portion 6*a* located on the lateral side of the unit body 1 and corresponding to a section B-B with the second bell mouth portion 6*b* located on the separator side and corresponding to a section C-C, an upstream extension length 17*a* of the first bell mouth portion 6*a* from a downstream end to an upstream end thereof is larger than an upstream extension length 17*b* of the second bell mouth portion 6*b* from a downstream end to an upstream end thereof.

Figure 3:
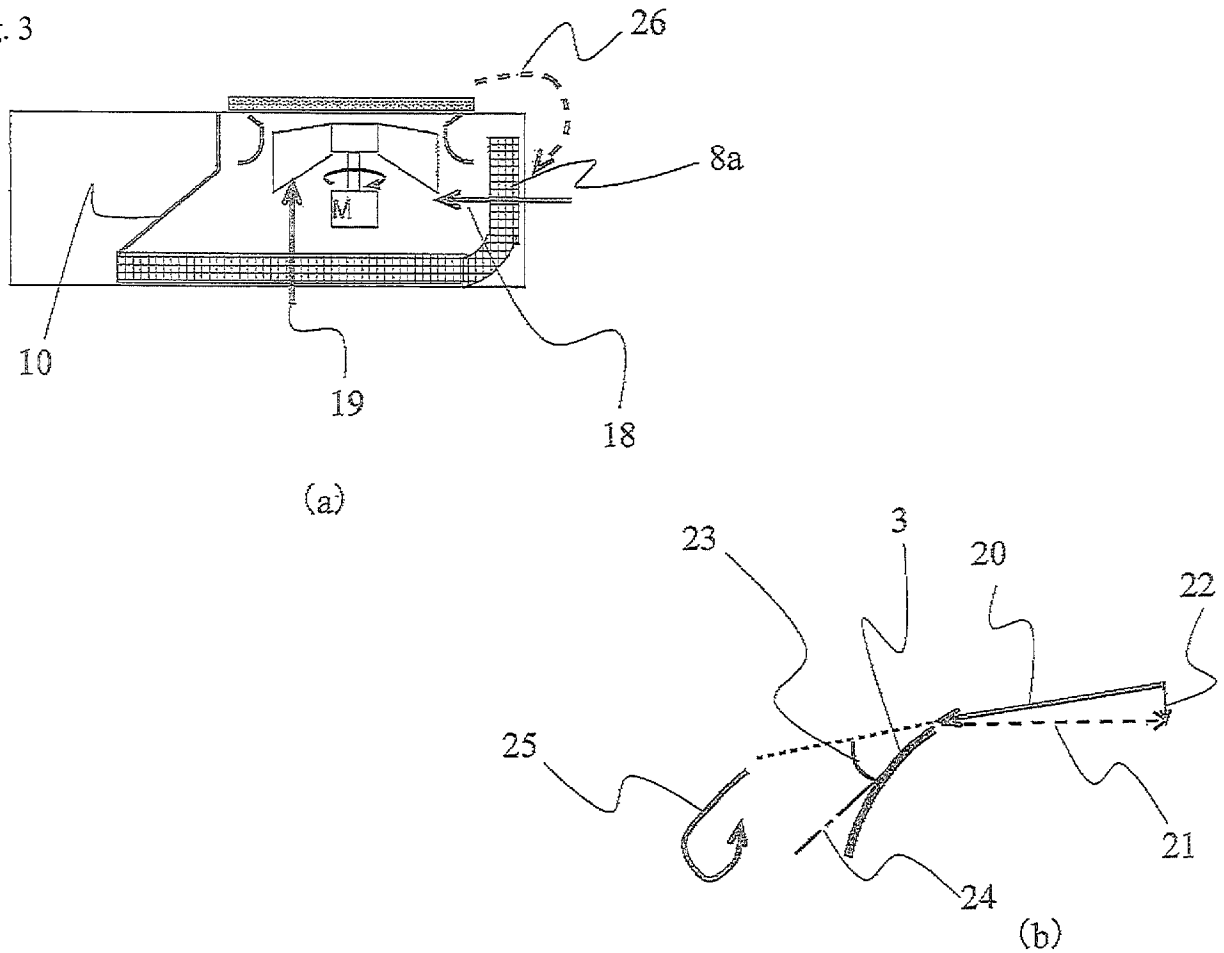
FIG. 3(*a*) is a schematic view of airstreams in an outdoor unit of a known air conditioner, and FIG. 3(*b*) is an explanatory view to explain aerodynamic actions upon a blade.
Figure 4:
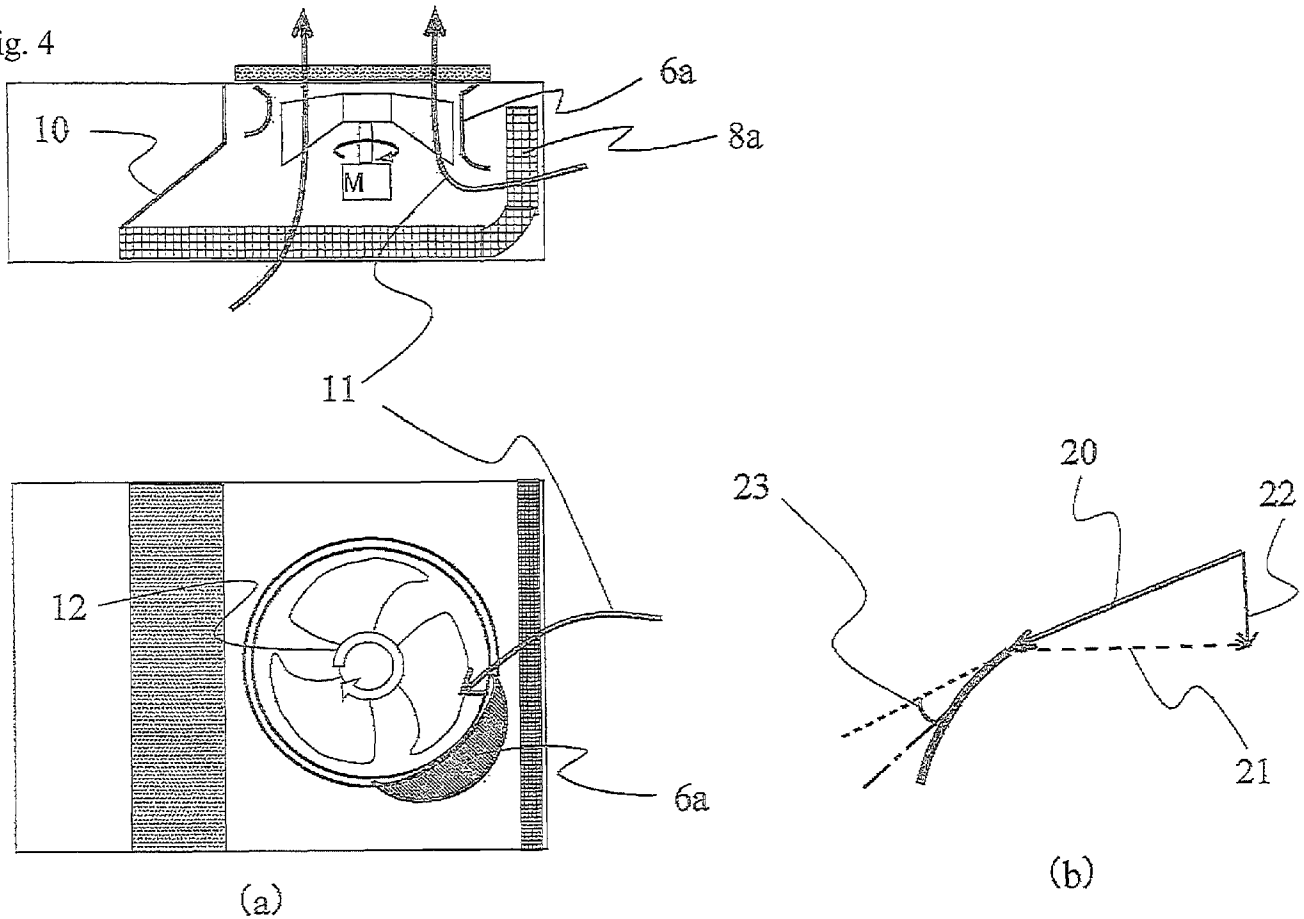
FIG. 4(*a*) is a schematic view of airstreams in an outdoor unit of the air conditioner according to Embodiment 1, and FIG. 4(*b*) is an explanatory view to explain aerodynamic actions upon the blade.

Operation will be described below with reference to FIGS. 3 and 4. FIG. 3(*a*) schematically illustrates airstreams in an outdoor unit of a known air conditioner as a comparative example, and FIG. 3(*b*) is an explanatory view to explain aerodynamic actions upon the blade 3. FIG. 4 represents this embodiment. More specifically, FIG. 4(*a*) is a schematic view of airstreams in an outdoor unit of the air conditioner according to this embodiment, and FIG. 4(*b*) is an explanatory view to explain aerodynamic actions upon the blade 3.

With the rotation of the propeller fan 4, outdoor air flows into the unit body 1 from the rear side and the lateral side thereof and passes through the heat exchanger 8. Airstreams flow toward the propeller fan 4 in such a manner that a stream 18 flowing in the radial direction of the propeller fan 4 is primary on the lateral side of the unit body 1 and thereabout where the lateral-side heat exchanger 8*a* is arranged, while a stream 19 flowing in the axial direction of the propeller fan 4 is primary in other places. On the side where the separator 10 is arranged, an air path is gradually narrowed and the speed of the axial stream is increased. Therefore, the flowing-in direction of the airstream to each blade, i.e., the flow field around the blade, is changed while the blade 3 mounted to the propeller fan 4 rotates one revolution. In particular, such a change occurs to a substantially different extent between the lateral side of the unit body where the lateral-side heat exchanger 8*a* is arranged and the separator side. As a result, forces exerted on the blade 3 vary and an angle at which the airstream flows along a tangential line 24 with respect to a curved line defining a front edge of the blade (i.e., an incident angle) also changes. FIG. 3(*b*) geometrically illustrates a relative flow direction 20 of the airstream flowing to the blade 3 based on a circumferential speed 21 of the blade and a speed 22 of the axial airstream flowing to the blade. On the lateral side of the unit body where the heat exchanger is arranged and the speed of the incoming axial airstream is small, the incident angle 23 (i.e., the angle formed between the tangential line 24 with respect to the curved line defining the front edge of the blade and the relative flow direction 20) is so increased as to cause a stall and to generate a vortex 25. This results in larger noise, lower efficiency of the propeller fan, and a larger shaft load. Upon the occurrence of a stall, a blown-off airstream tends to spread in the radial direction, thus causing a phenomenon, indicated by 26, that the airstream is sucked again into the lateral-side heat exchanger 8*a* installed on the lateral side of the unit body (i.e., a short cycle phenomenon).

On the other hand, the bell mouth according to this embodiment is formed, as shown in FIG. 1, such that, on the lateral side of the unit body where the lateral-side heat exchanger 8*a* is arranged, the first bell mouth portion 6*a*, which includes the sectional position and thereabout where the length of the segment 15 connecting the end 13 of the lateral-side heat exchanger 8*a* on the forward side in the fan rotating direction 12 and the fan center 14 is maximized, is formed to extend on the upstream side longer than the second bell mouth portion 6*b* which is located at the sectional position in a line-symmetrical relation to the first bell mouth portion 6*a* with respect to the vertical line 16 passing the fan center 14.

Accordingly, airstreams flow as shown in FIG. 4. More specifically, an airstream 11 incoming from the lateral side of the unit body flows toward the side of the fan following the rotating direction 12 of the propeller fan 4, as shown in FIG. 4(*a*). However, the airstream 11 is hard to flow into the propeller fan 4 in the radial direction thereof due to the presence of the first bell mouth portion 6*a* extending toward the upstream side on the forward side in the rotating direction, and the airstream 11 is caused to flow into the propeller fan 4 in the axial direction. Because the airstream on the side near the separator 10 inherently flows in the axial direction, the directions of the airstreams flowing into the propeller fan 4 become constant in the circumferential direction. Thus, the variations of the flow field caused during one revolution of the blade are reduced.

Figure 5:
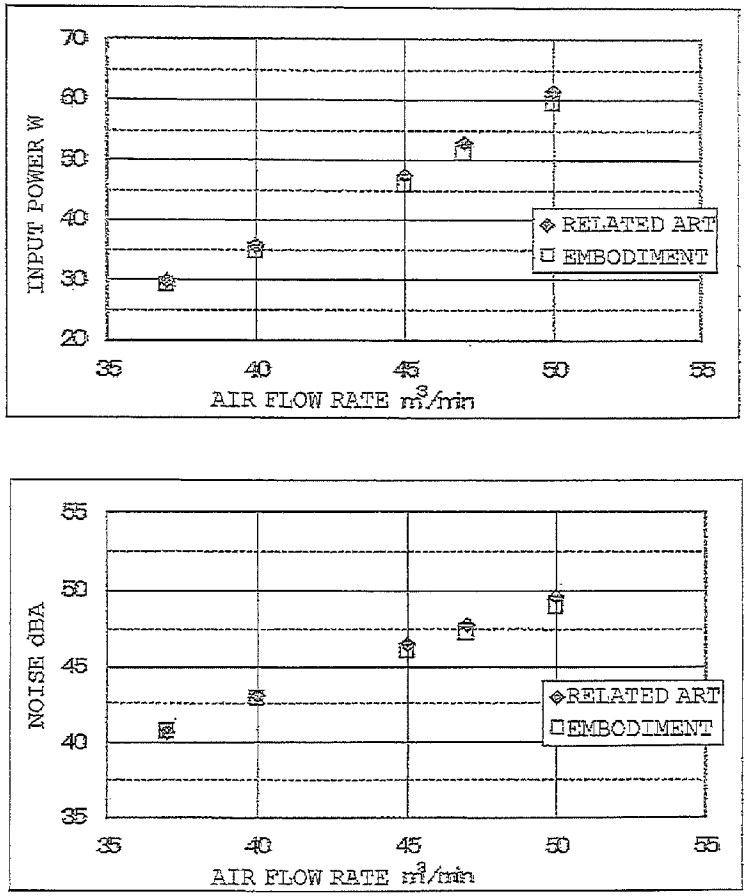
FIG. 5 illustrates results of actual measurements made on the air conditioner according to Embodiment 1.

FIG. 5 illustrates results of evaluating an actual unit to which the bell mouth of this embodiment is applied. As seen from FIG. 5, advantages have bee confirmed in points of reducing input power by about 5% and lessening noise by about 0.5 dB on condition of the same air flow rate.

Further, referring to FIG. 4(*b*) which illustrates, as in. FIG. 3(*b*) representing the related art, a relative flow direction 20 of the airstream flowing to the blade 3 in this embodiment, because the speed 22 of the axial airstream flowing to the blade is increased with the circumferential speed 21 kept the same, the incident angle 23 with respect to the blade is reduced and a stall is less apt to occur. As a result, the airstream blown off to the outside of the unit body becomes harder to spread in the radial direction. Accordingly, the phenomenon that the airstream is sucked again into the lateral-side heat exchanger 8*a* (i.e., the short cycle phenomenon) becomes less apt to occur, and deterioration of the performance can be prevented.

As described above, since the bell mouth is shaped such that, on the lateral side of the unit body where the lateral-side heat exchanger 8*a* is arranged, the first bell mouth portion 6*a*, which includes the sectional position and thereabout where the length of the segment connecting the end of the lateral-side heat exchanger on the forward side in the fan rotating direction and the fan center is maximized, is formed to extend on the upstream side longer than the second bell mouth portion 6*b* which is located at the sectional position in a line-symmetrical relation to the first bell mouth portion 6*a* with respect to the vertical line passing the fan center, an air conditioner can be realized in which an improvement in efficiency of the propeller fan and a reduction of noise are realized, and in which deterioration of performance due to the short cycle phenomenon is prevented.

Embodiment 2

Figure 6:
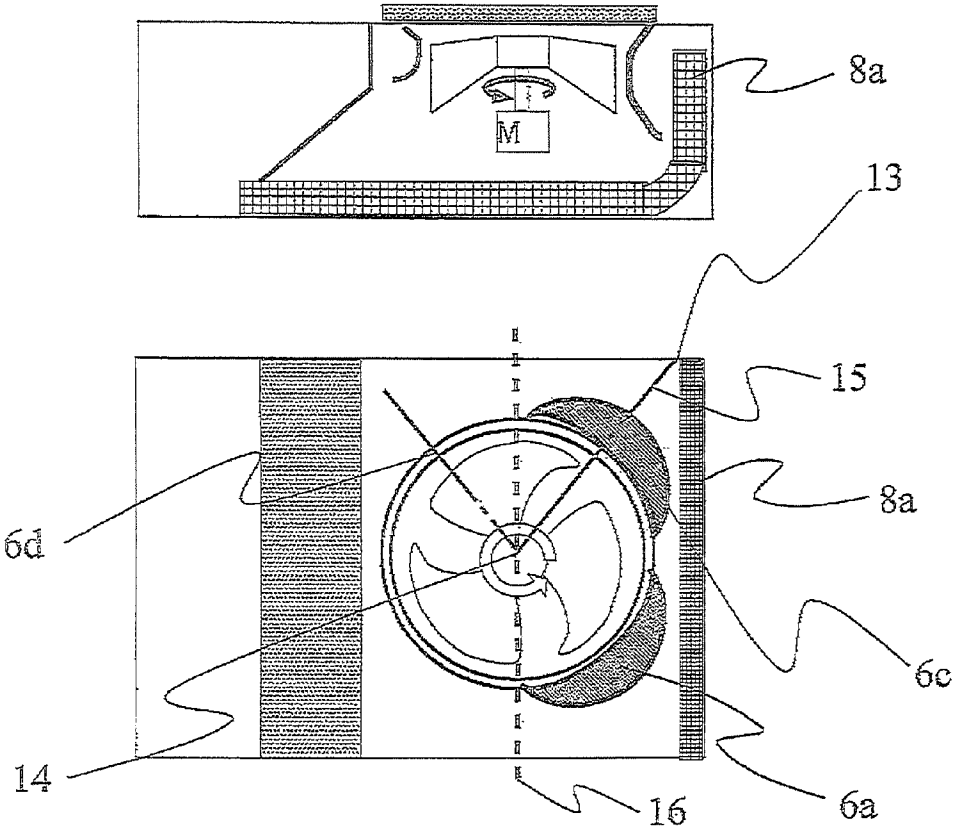
FIG. 6 illustrates the construction of an air conditioner according to Embodiment 2.

FIG. 6 is a sectional view of an air conditioner according to Embodiment 2 of the present invention.

In the above-described Embodiment 1, the first bell mouth portion 6*a* extending toward the upstream side is formed only on the forward side in the fan rotating direction. In contrast, the bell mouth 6 in this Embodiment 2 is formed such that, also on the backward side in the fan rotating direction in addition to the forward side, a third bell mouth portion 6*c*, which includes a sectional position and thereabout where a length of a segment 15 connecting an end 13 of the lateral-side heat exchanger 8*a* on the backward side in the fan rotating direction (e.g., an upper end thereof nearer to the front side of the unit body as viewed in the drawing corresponding to the backward side in the rotating direction) and the fan center 14 is maximized, is extended toward the upstream side longer than a fourth bell mouth portion 6*d* which is located at a sectional position in a line-symmetrical relation to the third bell mouth portion 6*c* with respect to the vertical line 16 passing the fan center 14. On the backward side in the rotating direction, an inflow amount of the airstream is less than that on the forward side in the rotating direction due to a specific nature of the fan rotation. However, it is the same that the airstream is going to flow into the side of the fan.

In view of such a point, the third bell mouth portion 6*c* is formed to extend longer toward the upstream side on the backward side in the rotating direction as well such that the airstream going to flow into the bell mouth in the radial direction is changed to the airstream flowing in the axial direction.

With this embodiment, since the direction of the airstream flowing into the fan is modified to the axial direction over the entire lateral side of the unit body 1 where the lateral-side heat exchanger 8*a* is arranged, the noise of the air conditioner is further reduced. As additional advantages, the short cycle phenomenon is even less apt to occur and the effect of preventing deterioration of the performance is increased.

Embodiment 3

Figure 7:
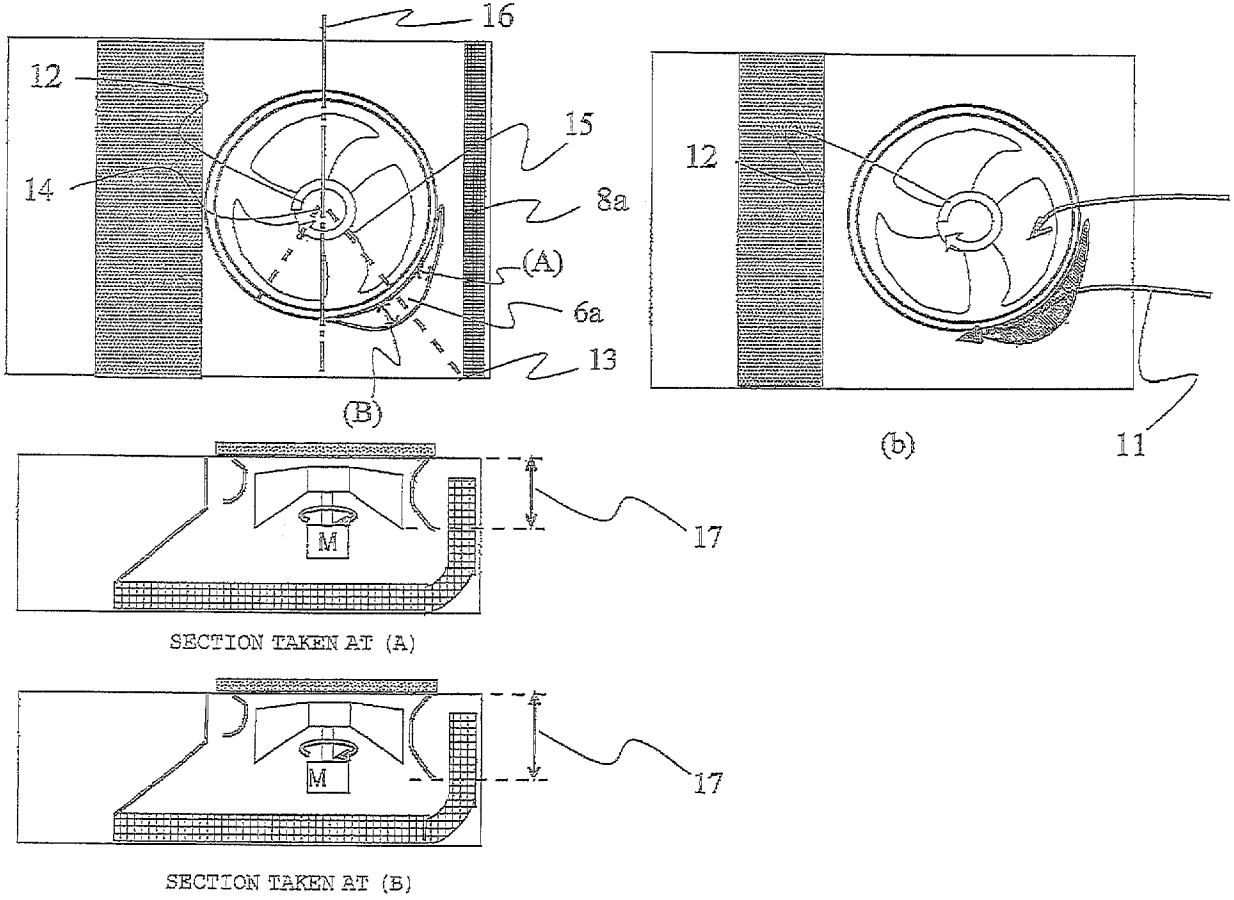
FIG. 7 illustrates the construction of an air conditioner according to Embodiment 3.

FIG. 7 is a sectional view of an air conditioner according to Embodiment 3 of the present invention.

As described above, on the lateral side of the unit body where the lateral-side heat exchanger 8*a* is arranged, the first bell mouth portion 6*a*, which includes the sectional position and thereabout where the length of the segment 15 connecting the end 13 of the lateral-side heat exchanger 8*a* on the forward side in the fan rotating direction 12 (e.g., the lower end thereof nearer to the rear side of the unit body as viewed in the drawing, though depending on the fan rotating direction) and the fan center 14 is maximized, is extended toward the upstream side longer than the second bell mouth portion 6*b* which is located at the sectional position in a line-symmetrical relation to the first bell mouth portion 6*a* with respect to the vertical line 16 passing the fan center 14. In addition to such an arrangement, in this embodiment, the upstream extension length 17 is gradually increased along the circumference of the first bell mouth portion 6*a* in the rotating direction 12 while defining a curved line (in order of a section taken at (A) and then a section taken at (B) in the drawing). The reason is as follows. As shown in FIG. 7(*b*), because the airstream 11 incoming from the lateral side of the unit body is dragged in the rotating direction 12 with the rotation of the propeller fan 4, the inflow amount is larger on the forward side in the rotating direction. Therefore, the upstream extension length of the first bell mouth portion 6*a* is gradually increased in the rotating direction to increase an effect of suppressing radial inflow of the airstream at a place where the airstream tends to be dragged in. The above-described form of the bell mouth functions to adjust such a suppression effect depending on the magnitude of the inflow amount from the lateral side of the unit body, thereby not only changing the flowing-in direction of the airstream into the fan to the axial direction, but also maintaining balance in the inflow amount. Accordingly, an inflow distribution in the circumferential direction is further uniformalized and even lower noise can be realized. In addition, the short cycle phenomenon can be more effectively prevented because the radial-inflow suppression effect of the bell mouth is caused to act at the place where the airstream tends to flow into the propeller fan 4 in the radial direction (i.e., the airstream tends to stall). The position of a point at which the upstream extension length 17 of the first bell mouth portion 6*a* is maximized is determined depending on the relationship among the outer diameter of the propeller fan 4, the size of the unit body 1, etc., and is set within the range of a predetermined angle from the segment 15 in the rotating direction.

Embodiment 4

Figure 8:
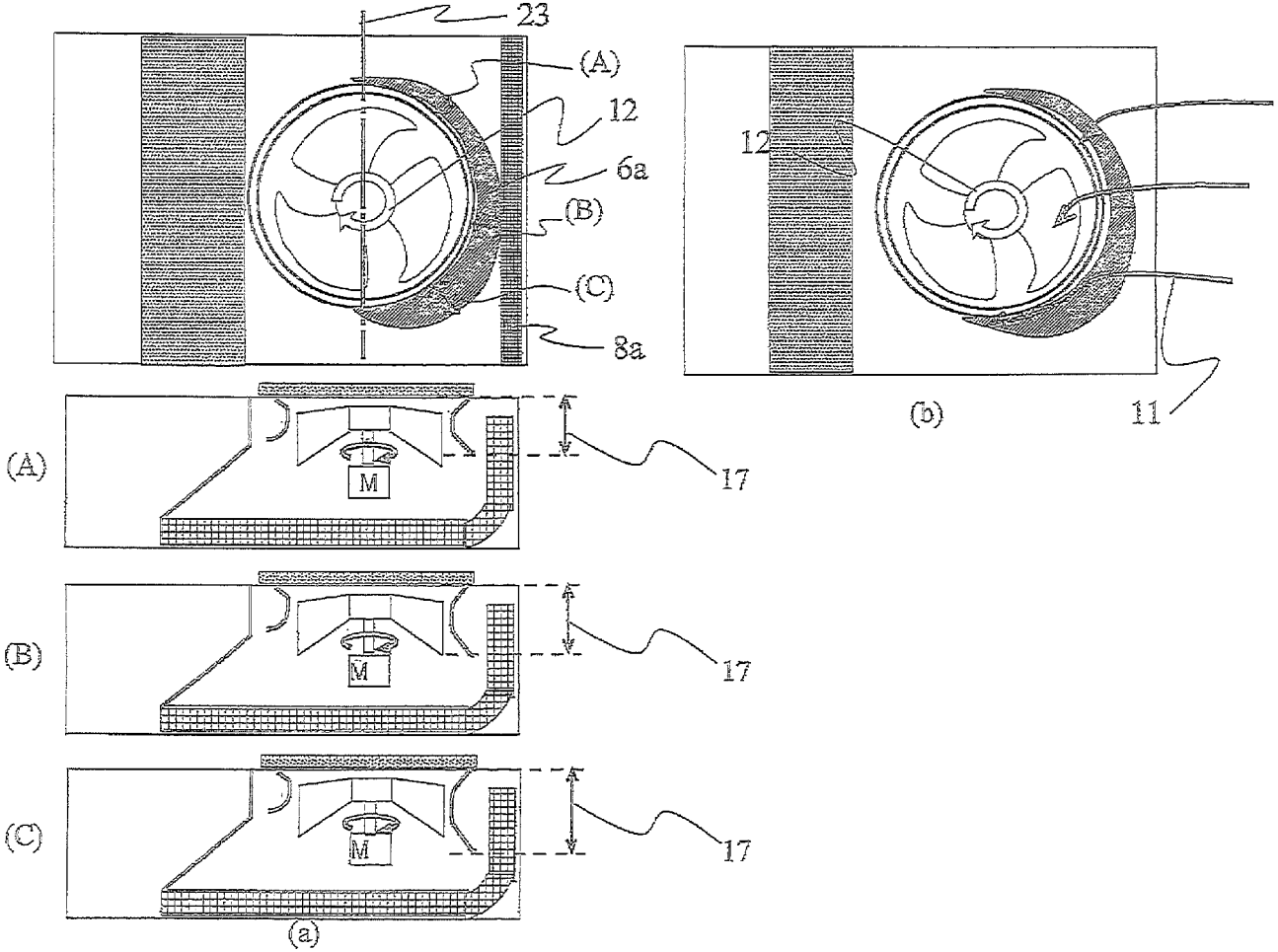
FIG. 8 illustrates the construction of an air conditioner according to Embodiment 4.

FIG. 8 is a sectional view of an air conditioner according to Embodiment 4 of the present invention.

In the above-described Embodiment 3, the upstream portion length is changed only in the first bell mouth portion in the fan rotating direction side on the lateral side of the unit body where the lateral-side heat exchanger 8*a* is arranged. In this Embodiment 4, the upstream portion length is expanded all over the region of the unit body where the lateral-side heat exchanger 8*a* is arranged.

Accordingly, the upstream portion length 17 of the first bell mouth portion 6*a* is not constant and is gradually elongated along the rotating direction 12 of the propeller fan 4 while defining a curved line (in order of (A), (B) and (C) in FIG. 8). As shown in FIG. 8(*b*), the airstream 11 incoming from the lateral side of the unit body flows in while the airstream 11 is dragged in the fan rotating direction 12 over the entire area.

With the arrangement, as in Embodiment 3, the amount of inflow to the lateral-side heat exchanger 8*a* is balanced and the flow distribution in the circumferential direction is further improved. Because the change of the upstream portion length is applied to the entire lateral side of the unit body where the lateral-side heat exchanger 8*a* is arranged, changes in the flow field during one revolution of the blade is further reduced and lower noise can be realized. In addition, because the effect of changing the flow direction of the airstream into the propeller fan 4 to the axial direction is similarly applied to the inverserotating direction side, a stall is prevented and the effect of preventing the short cycle phenomenon is further enhanced.

Embodiment 5

Figure 9:
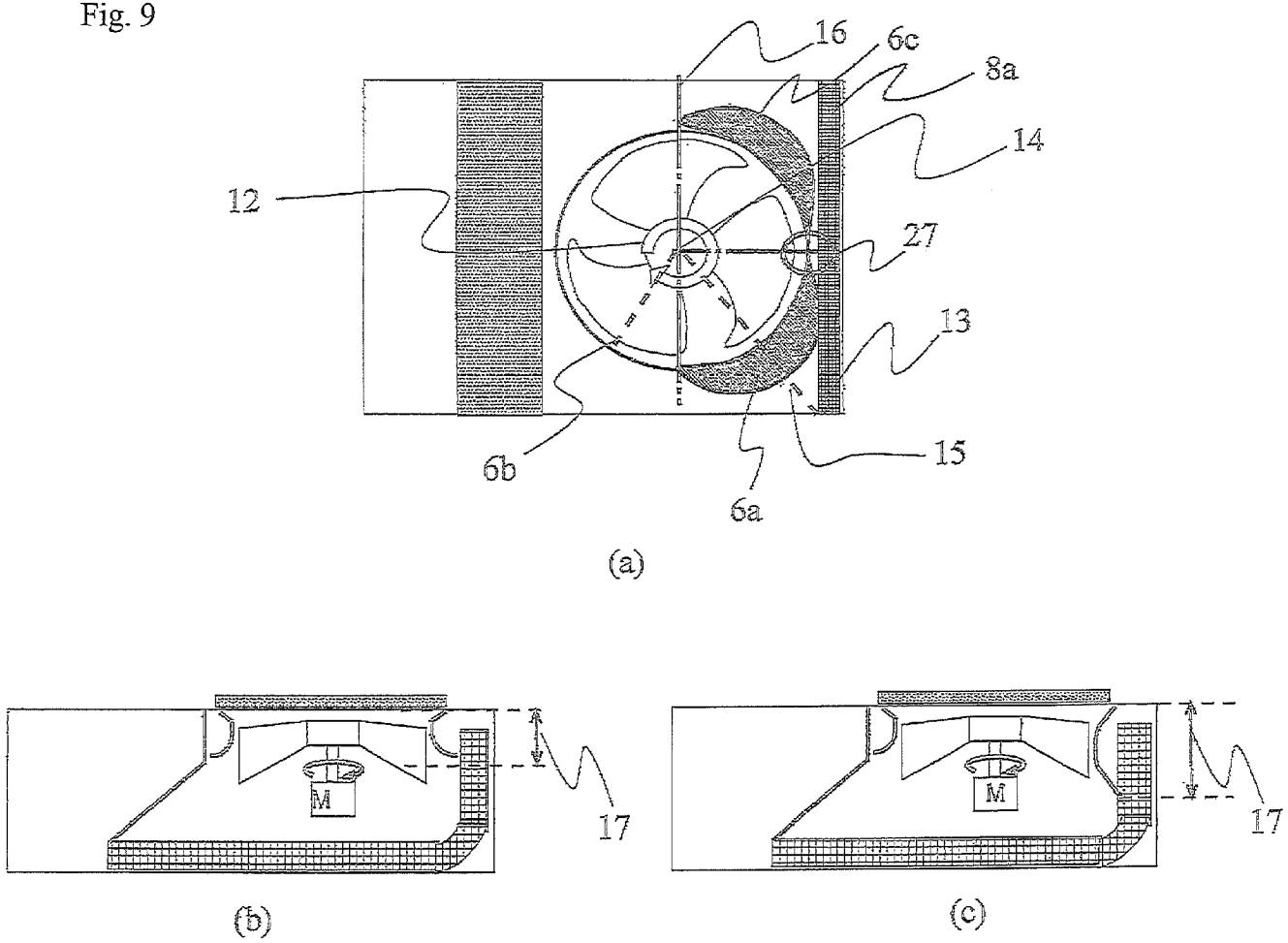
FIG. 9 illustrates the construction of an air conditioner according to Embodiment 5.

FIG. 9(*a*) is a rear sectional view of an air conditioner according to Embodiment 5 of the present invention. FIGS. 9(*b*) and 9(*c*) are each a plan sectional view of the air conditioner.

This Embodiment 5 is adapted for an air conditioner of the type that the propeller fan 4 installed in the unit body 1 has a large diameter. When the diameter of the propeller fan is increased to reduce noise of the air conditioner while the size of the unit body is kept compact, the distance between the outer periphery of the propeller fan 4 and the lateral-side heat exchanger 8*a* becomes very small. As described above, the bell mouth 6 is shaped such that, on the lateral side of the unit body where the lateral-side heat exchanger 8*a* is arranged, the first bell mouth portion 6*a*, which includes the sectional position and thereabout where the length of the segment 15 connecting the end 13 of the lateral-side heat exchanger 8*a* on the forward side in the fan rotating direction 12 (e.g., the lower end thereof nearer to the rear side of the unit body, though depending on the rotating direction 12) and the fan center 14 is maximized, is formed to have the upstream extension length 17 longer than that of the second bell mouth portion 6*b* which is located at the sectional position in a line-symmetrical relation to the first bell mouth portion 6*a* with respect to the vertical line 16 passing the fan center 14. Further, the third bell mouth portion 6*c* on the backward side in the rotating direction (i.e., on the upper side as viewed in the drawing) is also similarly formed. However, the upstream extension length 17 is set to be short at and near a position 27 where the distance between the outer periphery of the propeller fan 4 and the lateral-side heat exchanger 8*a* is very small (see the section shown in FIG. 9(*b*)).

Thus, in a region where the distance between the bell mouth 6 and the lateral-side heat exchanger 8*a* is very small, an influence of resistance caused by the lateral-side heat exchanger 8*a* is enlarged and a suction flow speed is not so increased. In such a region, therefore, the upstream extension length is set to be short so as not to impede passage of the airstream through the lateral-side heat exchanger 8*a*.

On the other hand, in other regions surrounding the place 27, because a relatively large space is held between the bell mouth 6 and the lateral-side heat exchanger 8*a* or each of air path walls (i.e., walls defining upper, bottom and lateral surfaces of the unit body 1), the respective upstream extension lengths of the first and third bell mouth portions 6*a* and 6*c* are increased to suppress the airstream from flowing in from the lateral side and to promote the axial flow, thus reducing the changes of the flow field (see the section shown in FIG. 9(*c*)). As a result, as in the above-described embodiments, the flow directions are uniformalized in the circumferential direction and the inflow amount is balanced. Hence, the reduction of noise, the prevention of a stall with the increased axial flow speed, and the prevention of the short cycle phenomenon can be realized in the air conditioner.

Embodiment 6

Figure 10:
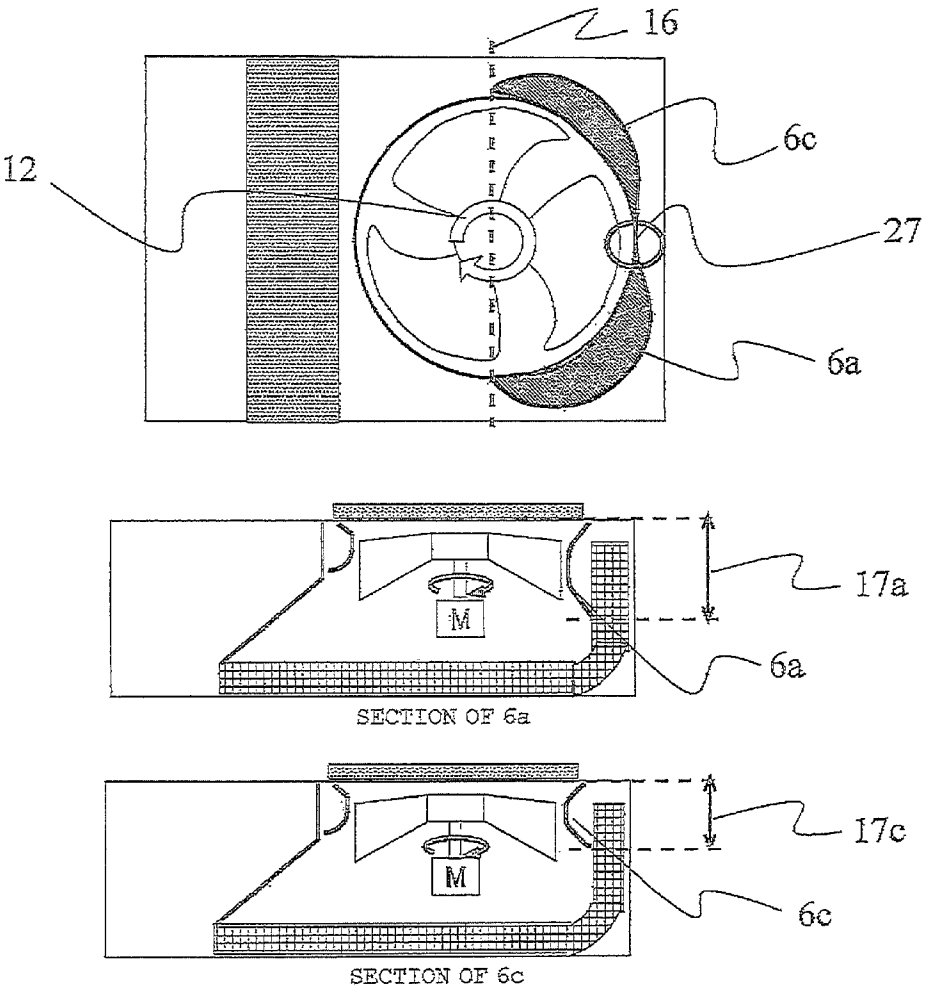
FIG. 10 illustrates the construction of an air conditioner according to Embodiment 6.

FIG. 10 is a sectional view of an air conditioner according to Embodiment 6 of the present invention.

This Embodiment 6 is modified based on Embodiment 5 by additionally considering an influence of the rotation of the propeller fan 4 in the rotating direction 12. More specifically, on the lateral side of the unit body where the lateral-side heat exchanger 8*a* is arranged, the first bell mouth portion 6*a* located on the forward side in the fan rotating direction has the upstream extension length 17*a* larger than the upstream extension length 17*c* of the third bell mouth portion 6*c* located on the backward side in the rotating direction (i.e., 17*a*>17*c*). Such an arrangement is employed in view of the fact that, as described above, the amount of the airstream incoming from the lateral side of the fan is increased on the forward side in the rotating direction. As a result, the inflow direction is more efficiently converted to the axial direction, whereby the inflow distribution is uniformalized in the circumferential direction and the inflow amount is balanced. Hence, the reduction of noise and the prevention of the short cycle phenomenon can be realized in the air conditioner.

Embodiment 7

Figure 11:
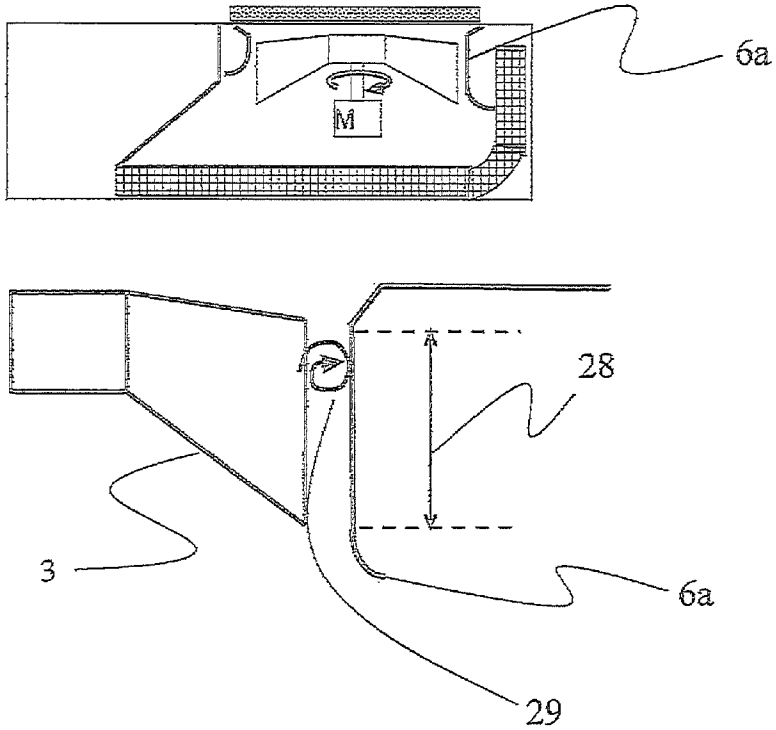
FIG. 11 illustrates the construction (No. 1) of an air conditioner according to Embodiment 7.
Figure 12:
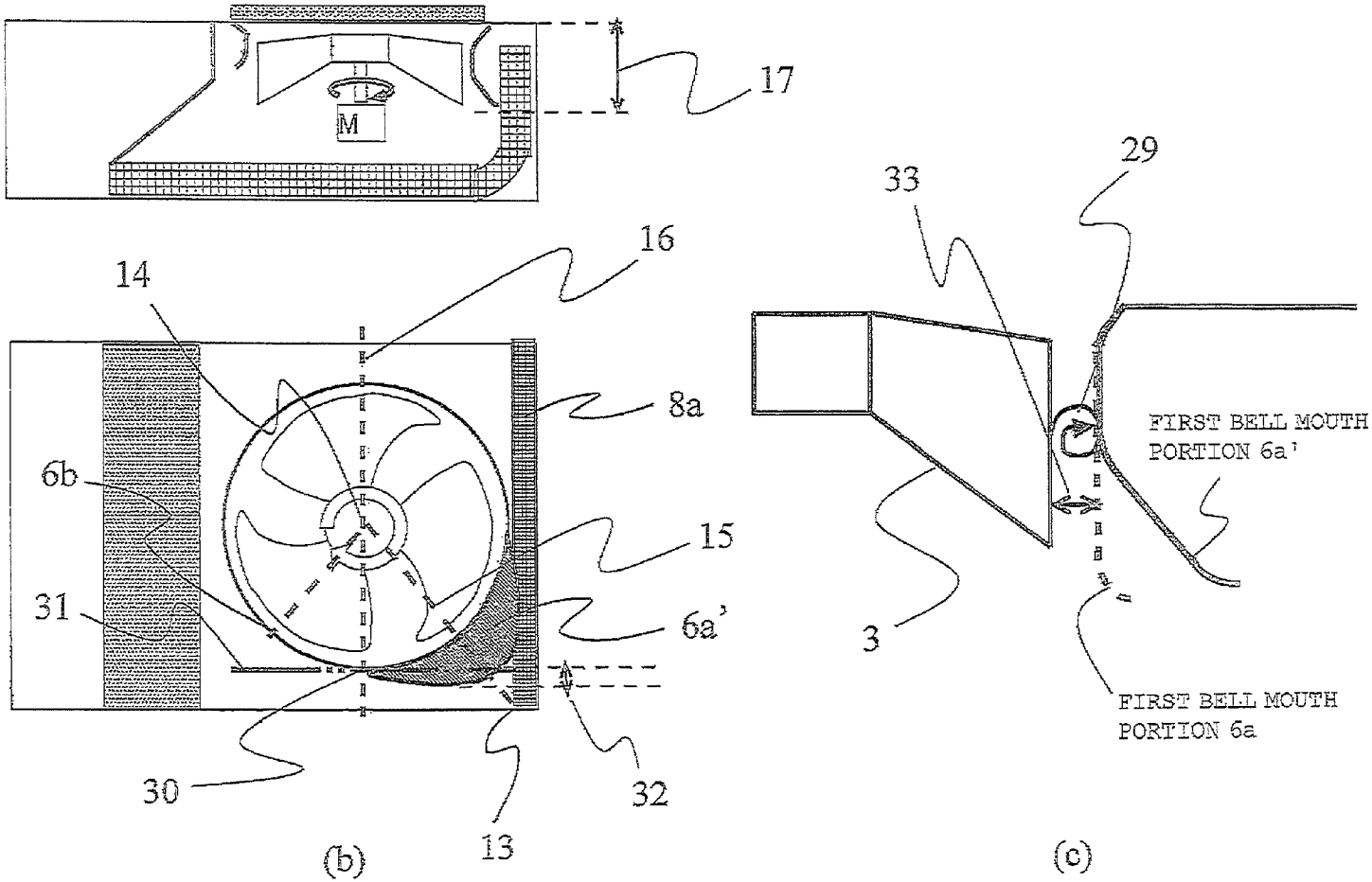
FIG. 12 illustrates the construction (No. 2) of the air conditioner according to Embodiment 7.

FIGS. 11 and 12 are each a sectional view of an air conditioner according to Embodiment 7 of the present invention.

This Embodiment 7 is adapted for the case that an extent of asymmetry of the air path is large and the upstream extension length 17 of the first bell mouth portion 6*a* is long.

Referring to FIG. 11, when extending the first bell mouth portion 6*a* toward the upstream side, if a cylindrical portion 28 (straight tubular portion) is extended straightly as shown in FIG. 11(*a*), the effect of suppressing the inflow from the lateral side is increased, but the following problem arises. Interference between a vortex 29 caused due to a pressure difference at the outer periphery of the blade (i.e., a vortex at the blade end) and a wall of the first bell mouth portion 6*a* is so intensified as to increase vibrations at the wall surface and to enlarge noise.

To overcome the above-mentioned problem, as shown in FIG. 12(*b*), on the lateral side of the unit body where the lateral-side heat exchanger 8*a* is arranged, a first bell mouth portion 6*a*', which includes the sectional position and thereabout where the length of the segment 15 connecting the end 13 of the lateral-side heat exchanger 8*a* on the forward side in the fan rotating direction 12 and the fan center 14 is maximized, is formed to extend on the upstream side longer than the second bell mouth portion 6*b* which is located at the sectional position in a line-symmetrical relation to the first bell mouth portion 6*a* with respect to the vertical line 16 passing the fan center 14. In addition to such an arrangement, the first bell mouth portion 6*a*' is formed in a shape having a length 32 extending outwards in the radial direction from a horizontal line 31 that passes a point where the vertical line 16 intersects a radial end of an upstream-side sucking portion of the bell mouth 6, which is located on the same side (lower side in the drawing) as the end 13 of the lateral-side heat exchanger 8*a*. In other words, the first bell mouth portion 6*a* has a shape extending toward the upstream side while spreading in the radial direction.

With the above-described arrangement, as shown in FIG. 12(*c*), comparing with the first bell mouth portion 6*a*, shown in FIG. 11, which has the cylindrical portion 18 extending straightly, the first bell mouth portion 6*a*' extending outwards in the radial direction can provide a larger distance 33 between the outer periphery of the blade 3 and the first bell mouth portion 6*a*'. Further, since the length of the cylindrical portion 28 is shortened, the interference between the vortex 29 and the wall of the first bell mouth portion 6*a*', which is caused due to the pressure difference, is weakened. As a result, the inherent purposes of suppressing the inflow from the lateral side, uniformalizing the inflow distribution, and realizing even lower noise can be achieved. Moreover, since the direction of the airstream flowing into the fan is converted to the axial direction while being gradually narrowed, a stall is less apt to occur and the short cycle phenomenon can be prevented with higher reliability.

Embodiment 8

Figure 13:
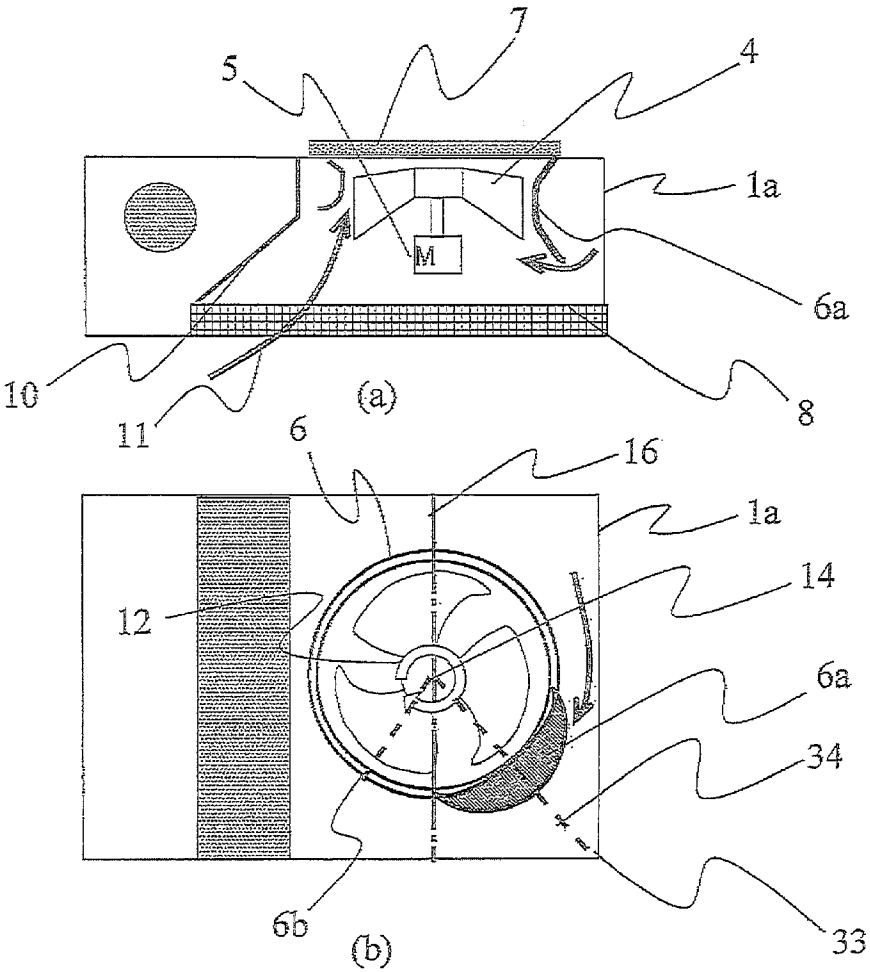
FIG. 13 illustrates the construction of an air conditioner according to Embodiment 8.

FIG. 13 is a sectional view of an air conditioner according to Embodiment 8 of the present invention. This Embodiment 8 is adapted for an air conditioner of the type that performance is relatively low and the heat exchanger 8 is installed at a shorter width. In this embodiment, the heat exchanger 8*a* has not an L-shape unlike the above-described embodiments, and a wall is provided only on the lateral side where the lateral-side heat exchanger 8*a* is arranged in the above-described embodiments. Stated another way, the heat exchanger 8 in this embodiment is installed only on the rear side of a straight-type unit body 1.

Although there is no inflow from the lateral side of the unit body, the inflow directions are unbalanced between the right side and the left side. The reason is as follows. The separator 10 is formed so as to gradually narrow the air path extending from the heat exchanger 8 toward the bell mouth 6, and the airstream 11 has a large axial stream immediately before the fan. On the lateral side of the unit body, however, there is no air path narrowing toward the fan, and air residing in the bell mouth 6 and corners of the air path is caused to flow into the fan from the lateral side. In other words, the air conditioner of this type also has a feature that the directions of airstreams flowing into the fan differ between the right side and the left side.

In the air conditioner equipped with the straight-type heat exchanger 8, therefore, the bell mouth 6 is formed such that, on the lateral side of the unit body where the heat exchanger is not arranged, the first bell mouth portion 6*a*, which includes a sectional position and thereabout where a length of a segment 34 connecting a corner 33 of a lateral wall 1*a* (or a corner 33 of the air path) on the forward side in the rotating direction 12 and the fan center 14 is maximized, is extended toward the upstream side longer than the second bell mouth portion 6*b* which is located at the sectional position in a line-symmetrical relation to the first bell mouth portion 6*a* with respect to the vertical line 16 passing the fan center 14. As a result, in the lateral side where the heat exchanger is not arranged, the inflow direction is modified from the radial direction to the axial direction and the flow directions are uniformalized in the circumferential direction. Hence, similar advantages to those of Embodiment 1 can be obtained.

Embodiment 9

Figure 14:
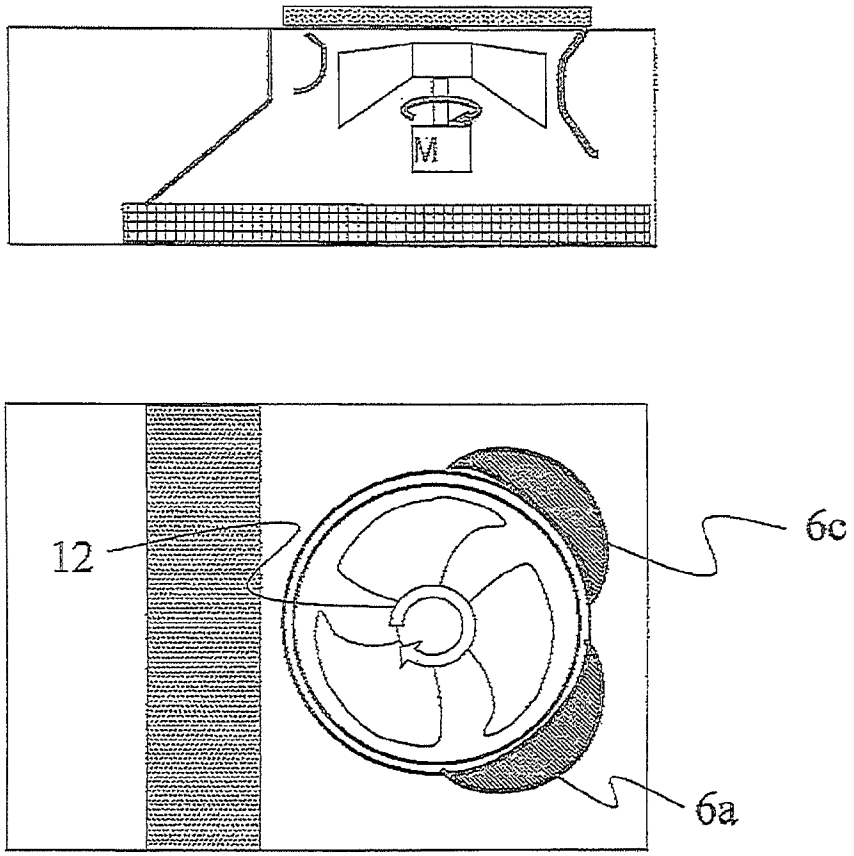
FIG. 14 illustrates the construction of an air conditioner according to Embodiment 9.

FIG. 14 is a sectional view of an air conditioner according to Embodiment 9 of the present invention.

In this Embodiment 9, on the lateral side of the unit body where the heat exchanger is not arranged, not only the first bell mouth portion 6*a* on the forward side in the fan rotating direction 12, but also the third bell mouth portion 6*c* on the backward side in the fan rotating direction are formed to extend longer toward the upstream side as in Embodiment 2.

Similarly to the advantages of Embodiment 2, since the inflow direction can be changed to the axial direction on the entire lateral side of the unit body where the heat exchanger is not arranged and the airstream is apt to flow into the fan from the side thereof, the flow field can be made more uniform and even lower noise can be realized. The shape of the bell mouth is similar to that in Embodiment 2, and therefore a detailed description on the shape of the bell mouth is omitted.

Embodiment 10

Figure 15:
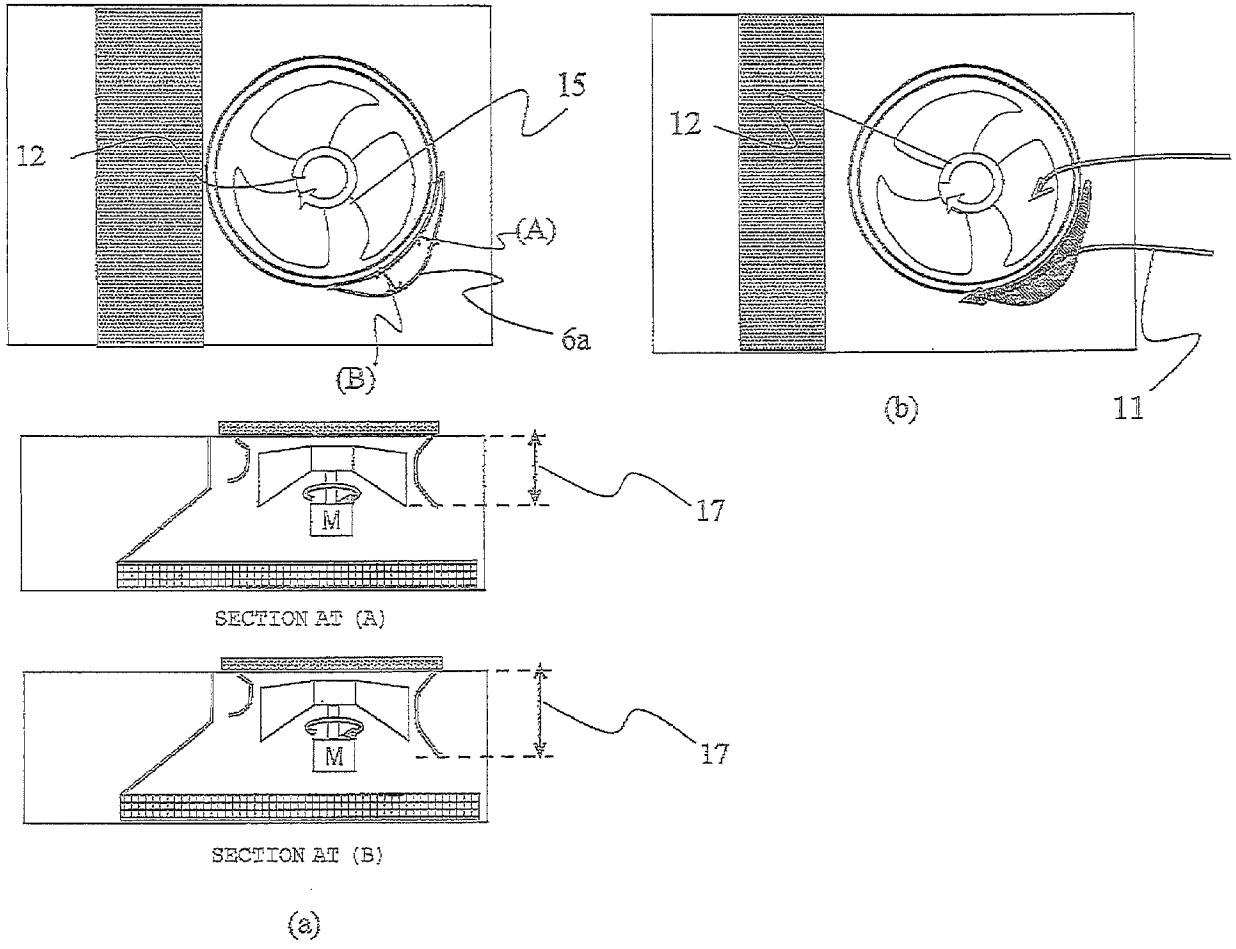
FIG. 15 illustrates the construction of an air conditioner according to Embodiment 10.

FIG. 15 is a sectional view of an air conditioner according to Embodiment 10 of the present invention.

In this Embodiment 10, on the lateral side of the unit body where the heat exchanger is not arranged, the upstream extension length 17 of the first bell mouth portion 6*a* is gradually increased in the fan rotating direction 12 while defining a curved line (in order of a section taken at (A) and then a section taken at (B) in the drawing), in substantially the same way as that in Embodiment 3.

Similarly to the advantages of Embodiment 3, in addition to changing the inflow direction to the axial direction on the lateral side of the unit body where the heat exchanger is not arranged, the radial-inflow suppression effect is balanced by regulating the inflow amount of the airstream 11 that is dragged in with the fan rotation. Accordingly, the inflow distribution is uniformalized, whereby the further reduction of noise and the prevention of the short cycle phenomenon can be realized.

Embodiment 11

Figure 16:
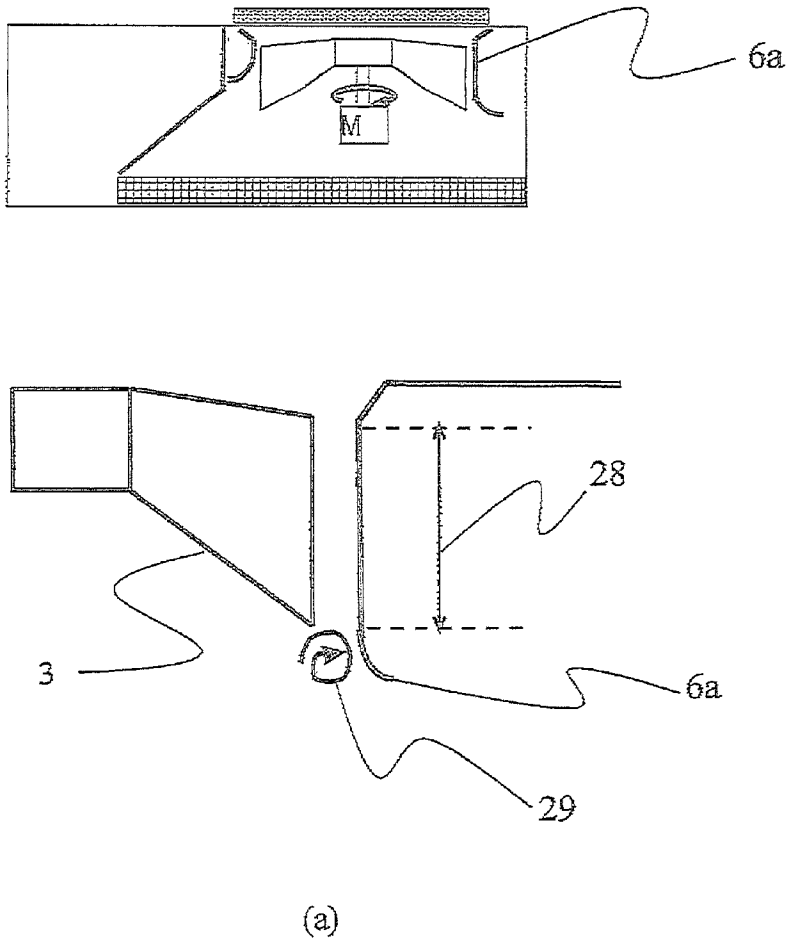
FIG. 16 illustrates the construction (No. 1) of an air conditioner according to Embodiment 11.
Figure 17:
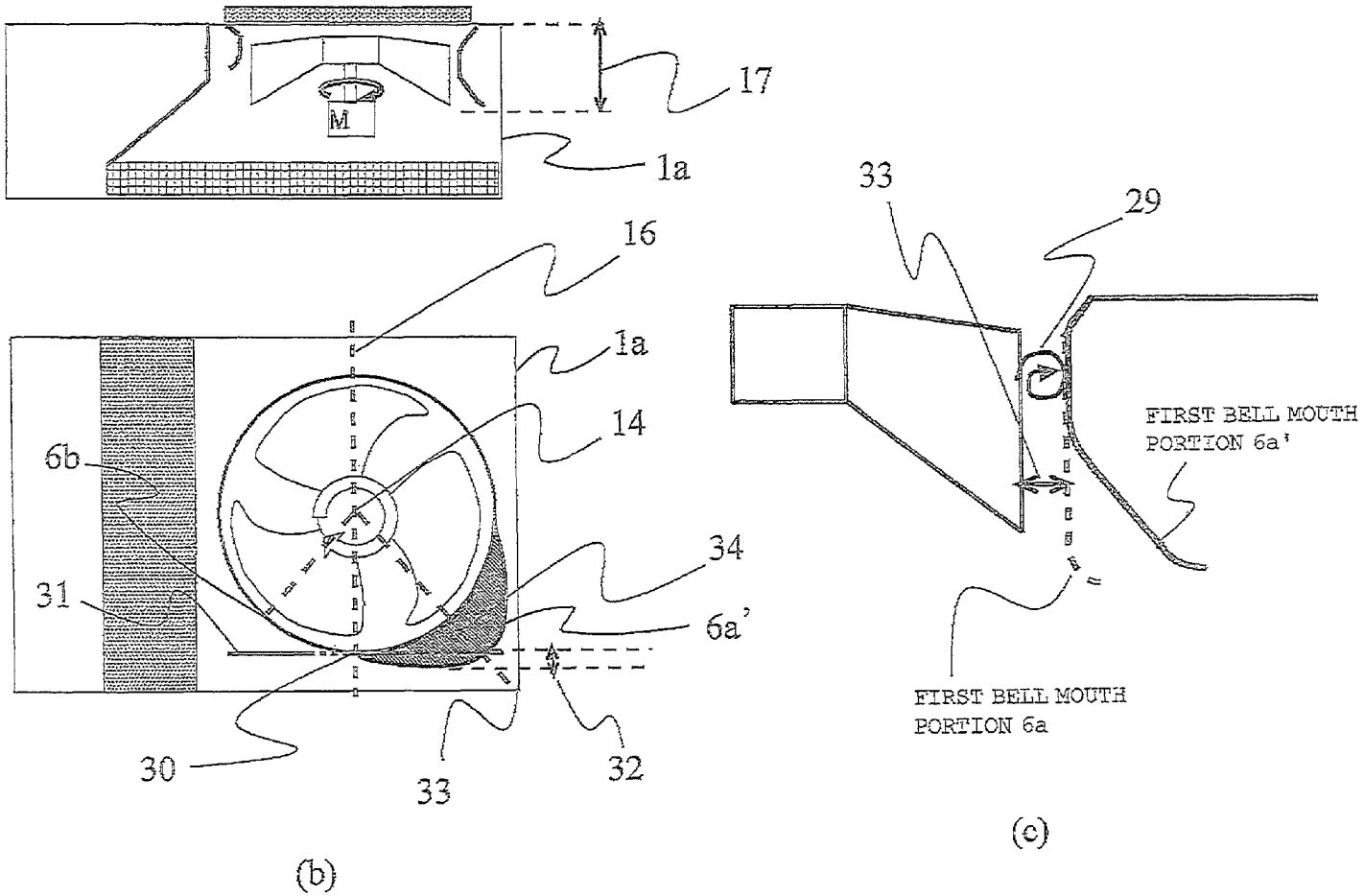
FIG. 17 illustrates the construction (No. 2) of the air conditioner according to Embodiment 11.

FIGS. 16 and 17 are each a sectional view of an air conditioner according to Embodiment 11 of the present invention.

This Embodiment 11 is to address the following problem similarly to Embodiment 7. When extending the first bell mouth portion 6*a* toward the upstream side, if a cylindrical portion 28 is extended in the same radius, the effect of suppressing the inflow from the lateral side is increased, but interference between a vortex 29 caused due to a pressure difference at the outer periphery of the blade (i.e., a vortex at the blade end) and a wall surface of the first bell mouth portion 6*a* is so intensified as to increase vibrations at the wall surface and to enlarge noise (see FIG. 16(*a*)).

To overcome the above-mentioned problem, as shown in FIG. 17(*b*), on the lateral side of the unit body where the heat exchanger is not arranged, a first bell mouth portion 6*a*', which includes a sectional position and thereabout where a length of a segment 34 connecting a corner 33 of a lateral wall 1*a* (or a corner 33 of an air path) on the forward side in the fan rotating direction and the fan center 14 is maximized, is formed to extend on the upstream side longer than the second bell mouth portion 6*b* which is located at the sectional position in a line-symmetrical relation to the first bell mouth portion 6*a* with respect to the vertical line 16 passing the fan center 14. In addition to such an arrangement, the first bell mouth portion 6*a* is formed in a shape having a length 32 extending outwards in the radial direction from a horizontal line 31 that passes a point where the vertical line 16 intersects a radial end of an upstream-side sucking portion of the bell mouth 6, which is located on the same side as the corner 33 of the lateral wall 1*a*. Advantages of this embodiment are similar to those of Embodiment 7 and therefore a description of the advantages is omitted.

Embodiment 12

Figure 18:
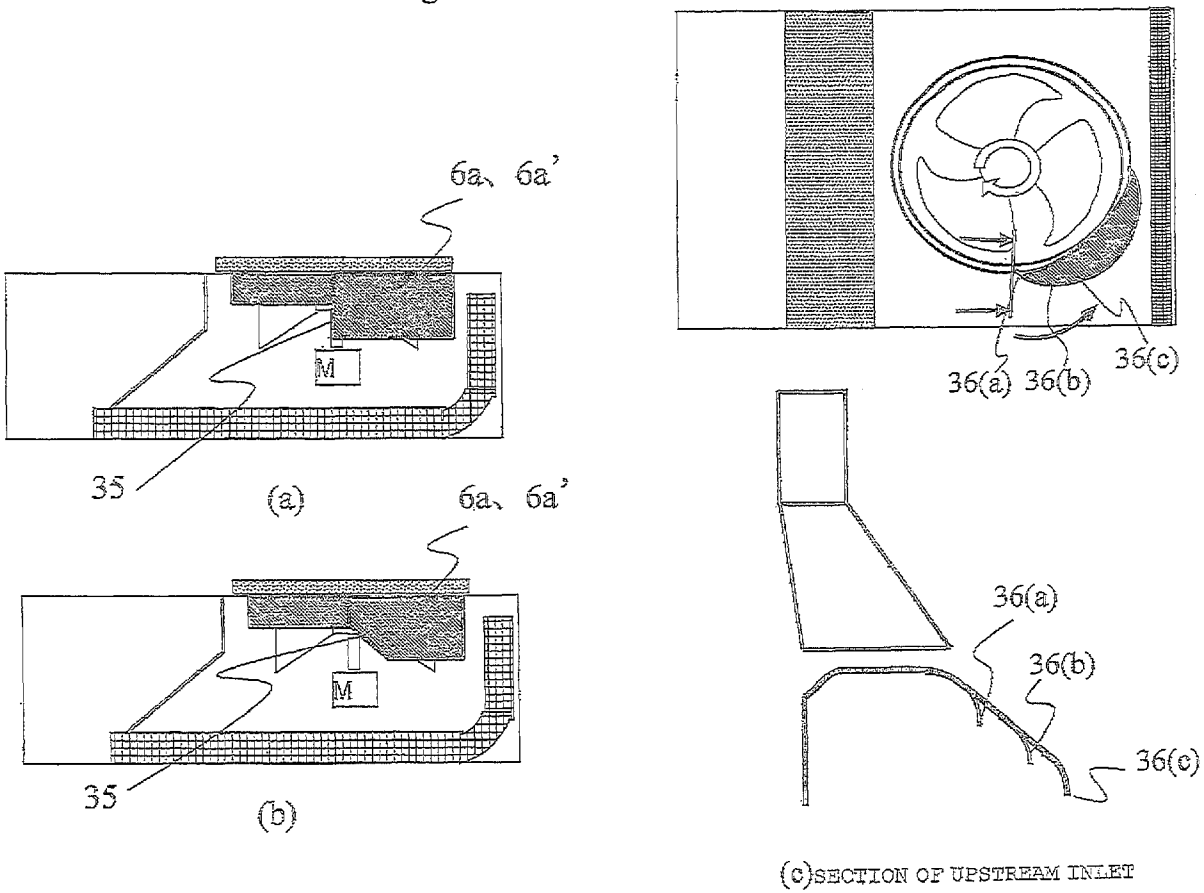
FIG. 18 illustrates the construction of an air conditioner according to Embodiment 12.

FIG. 18 is a sectional view of an air conditioner according to Embodiment 12 of the present invention.

This Embodiment 12 relates to sectional shapes of the first and third bell mouth portions extending toward the upstream side. Each of the first and third bell mouth portions 6*a*, 6*a*' and 6*c* employed in the above-described embodiments has the sectional shape changing in the circumferential direction. When, at a place 35 where the sectional shape is changed in the circumferential direction, the bell mouth has such a steplike level difference as shown in FIG. 18(*a*) or such a flat section as shown in FIG. 18(*b*) though the sectional shape is smoothly changed over its length, wind noise is generated upon passage of the airstream, thus impeding the effect of uniformalizing the flow distribution and reducing the noise. To overcome such a problem, as shown in FIG. 18(*c*), an upstream inlet section 36 of the first bell mouth portion 6*a* or 6*a*' in which the upstream extension length is changed is formed to have a circular arc-shaped or spline curve such that the airstream can smoothly pass the place 35. As seen from the drawing, the upstream inlet section 36 is smoothly changed step by step from 36(*a*) to 36(*c*). Though not shown, the third bell mouth portion 6*c* is also formed to have a similar sectional shape.

With the above-described arrangement, since the airstream smoothly flows without generating wind noise even in a region of the bell mouth portion in which the sectional shape is changed, the effect intended by extending the first and third bell mouth portions toward the upstream side is effectively realized.

Embodiment 13

Figure 19:
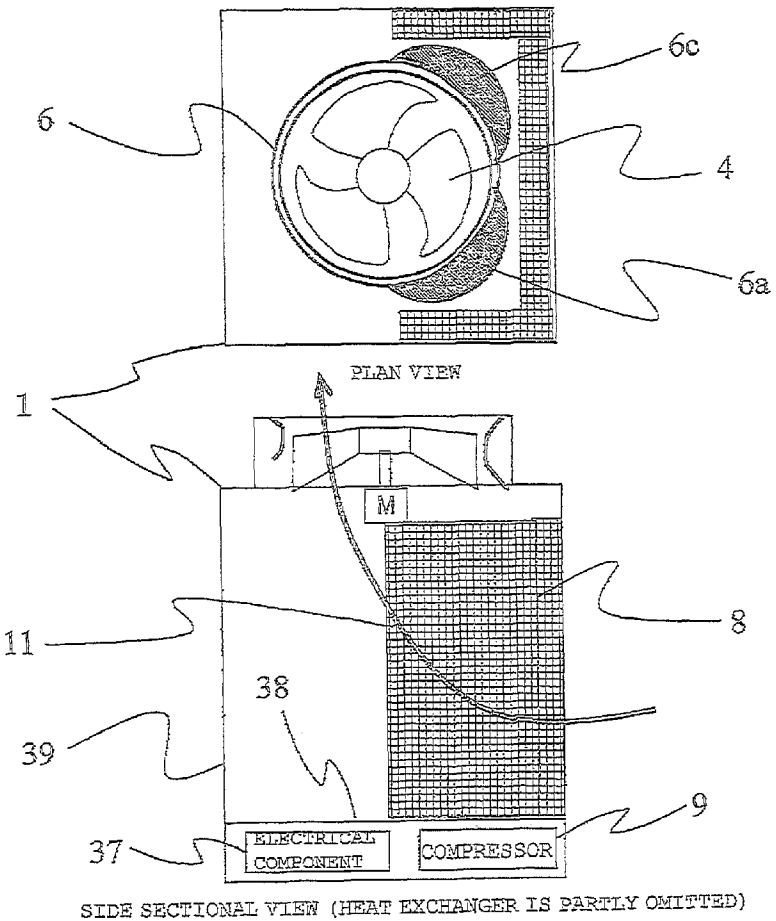
FIG. 19 illustrates the construction of an air conditioner according to Embodiment 13.

While the description has been made above on the air conditioner in which air is laterally blown off, an air conditioner with a large capacity often has an outdoor unit in which air is blown off upward as shown in FIG. 19.

The air conditioner of this Embodiment 13 includes a propeller fan 4 installed at a top of a unit body 1, a substantially C-shaped heat exchanger 8 installed at sides of the unit body 1 in a lower portion thereof, and a bell mouth 6 installed radially outward of the propeller fan 4. A compressor 9 for supplying a refrigerator to the heat exchanger 8, an electrical component 37, and other parts are installed under an intermediate partition plate 38. Accordingly, that type of vertical outdoor unit does not have the partition plate that has been described in the foregoing embodiments. As seen from the illustrated construction, however, an air path is defined on the lower side of the unit body 1 by the substantially C-shaped heat exchanger 8 and a unit wall surface 39 where the heat exchanger 8 is not arranged. An airstream 11 is caused to flow into the unit body from three directions in the lower side with the operation of the propeller fan 4 installed at the top, and then to blow off upwards after being subjected to heat exchange. Thus, the air path is asymmetrical as viewed from the propeller fan 4. Accordingly, the above-described shape of the bell mouth 6 can also be applied to the air conditioner of this embodiment and the reduction of noise can be realized.

The invention claimed is:

1. An air conditioner comprising:

a unit body;

an L-shaped heat exchanger configured with a lateral-side heat exchanger installed on a lateral surface of the unit body and a rear-side heat exchanger installed on a rear surface of the unit body wherein the L-shaped heat exchanger has an L-shape in a horizontal plane;

a propeller fan provided in the unit body so as to be surrounded by the L-shaped heat exchanger for generating a flow from sucking ports formed on the lateral surface of the unit body and on the rear surface of the unit body to a blow-off port formed in a front panel of the unit body;

a bell mouth installed radially outward of the propeller fan; and a partition plate to partition an installation space of a compressor for supplying a refrigerant to the heat exchanger and an installation space of the propeller fan and to guide an airstream from the heat exchanger toward the bell mouth, wherein the bell mouth has a first bell mouth portion which includes a sectional portion and a vicinity of the sectional portion, the sectional portion being intersected by a line segment that extends from a horizontal end of the lateral-side heat exchanger proximate to the first bell mouth portion to a center of the propeller fan, the sectional portion and the vicinity of the sectional portion have different dimensions in different respective radial directions of the propeller fan from an inner portion of the first bell mouth portion to an outer portion of the first bell mouth portion at an upstream side of the propeller fan of the first bell mouth portion, wherein the largest of said dimensions is along the line segment between the center of the propeller fan and the end of the lateral-side heat exchanger, and a second bell mouth portion which is located at the partition plate side of a sectional portion in a line-symmetrical relation to the first bell mouth portion with respect to a vertical line passing the center of the propeller fan, and the bell mouth is formed such that the first bell mouth portion extends in an upstream direction of the propeller fan a longer distance than the second bell mouth portion.

2. The air conditioner of claim 1, wherein the bell mouth further has a third bell mouth portion which includes a sectional portion and a vicinity of the sectional portion, the sectional portion being intersected by a line segment that extends from an other end of the lateral-side heat exchanger to the fan center, and the sectional portion of the third bell mouth portion has a largest dimension, from an inner portion of the third bell mouth portion to an outer portion of the third bell mouth portion at the upstream side of the propeller fan of the third bell mouth portion, along the line segment between the center of the propeller fan and the other end of the lateral-side heat exchanger, and a fourth bell mouth portion which is located at a sectional position in a line-symmetrical relation to the third bell mouth portion with respect to the vertical line passing the center of the propeller fan, and the bell mouth is formed such that the third bell mouth portion extends in the upstream side a longer distance than the fourth bell mouth portion.

3. The air conditioner of claim 1, wherein an upstream portion length which is a length of the first bell mouth portion from a downstream end of the first bell mouth portion to an upstream end of the first bell mouth portion in an axial direction of the propeller fan, and the upstream portion length has an increased dimension along the direction of rotation of the fan and defines a curved line.

4. The air conditioner of claim 2, wherein the first bell mouth portion and the third bell mouth portion are separated at a portion which is closest to the lateral-side heat exchanger arranged on the lateral side of the unit body and the center of the propeller fan, an upstream portion length of the first bell mouth portion is a length from a downstream end of the first bell mouth portion to an upstream end of the first bell mouth portion in an axial direction of the propeller fan, and an upstream portion length of the third bell mouth portion is a length from a downstream end of the third bell mouth portion to an upstream end of the third bell mouth portion in the axial direction of the propeller fan, and the upstream portion length of the first bell mouth portion at a location adjacent to the portion is longer than the upstream portion length of the third bell mouth portion at a location adjacent to the portion.

5. The air conditioner of claim 2, wherein an upstream portion length which is a length of each of the first bell mouth portion and the third bell mouth portion from downstream ends of the first bell mouth portion and the third bell mouth portion to upstream ends of the first bell mouth portion and the third bell mouth portion in an axial direction of the propeller fan, and the upstream portion length increases along the direction of rotation of the fan while defining a curved line.

* * * * *